US007036152B2

(12) United States Patent
Gafforio et al.

(10) Patent No.: US 7,036,152 B2
(45) Date of Patent: May 2, 2006

(54) ANTI-FOG VISORS ASSEMBLY

(75) Inventors: Luca Gafforio, Comun Nuovo (IT); Alberto Salvetti, Bergamo (IT); Gabriele Tomasoni, Bariano (IT)

(73) Assignee: Opticos S.r.l., Brembate di Sopra (IT)

( * ) Notice: Subject to any disclaimer, the term of this patent is extended or adjusted under 35 U.S.C. 154(b) by 35 days.

(21) Appl. No.: 10/937,884

(22) Filed: Sep. 10, 2004

(65) Prior Publication Data

US 2005/0066427 A1 Mar. 31, 2005

(30) Foreign Application Priority Data

Sep. 12, 2003 (IT) ..... MI20030411 U

(51) Int. Cl.
*A61F 9/00* (2006.01)

(52) U.S. Cl. ..... 2/15; 2/424; 2/435

(58) Field of Classification Search ..... 2/15, 2/424, 6.3, 6.4, 6.5, 6.7, 10, 434, 9, 441, 2/443, 435, 429

See application file for complete search history.

(56) References Cited

U.S. PATENT DOCUMENTS 2,952,853 A * 9/1960 Benzel ..... 2/429
3,805,294 A * 4/1974 Rose et al. ..... 2/10
3,890,647 A * 6/1975 Wamcke ..... 2/435
4,907,299 A * 3/1990 Arai ..... 2/424
4,989,274 A * 2/1991 Patelski, III ..... 2/436
5,765,235 A * 6/1998 Arnold ..... 2/424
6,102,033 A * 8/2000 Baribeau et al. ..... 128/201.24
6,405,373 B1 * 6/2002 Grau ..... 2/15
6,922,850 B1 * 8/2005 Arnold ..... 2/424
2005/0150028 A1 * 7/2005 Broersma ..... 2/9

* cited by examiner

*Primary Examiner*—Rodney M. Lindsey
(74) *Attorney, Agent, or Firm*—Nixon & Vanderhye P.C.

(57) ABSTRACT

Anti-fog visors assembly comprising at least an external visor (5) and at least an internal visor (6) at least partially kept in abutment on the internal surface of said external visor by way of mechanical retaining means. Said mechanical retaining means comprise at least two retainers (1, 1') coupled to the external visor, wherein the internal visor is lodged, and is retained. Advantageously, at least one of the two retainers is a pin (1) rotatable with respect to the internal visor, and which comprises a portion (4) for the engagement with the same internal visor, which has at least a region for the loose engagement and at least a region for the tight engagement (15), depending on the rotation angle reached by the rotatable pin. Moreover, the aforesaid rotatable pin is jointed to means (3) for imposing its rotation which extend to the outside of the external visor.

14 Claims, 4 Drawing Sheets

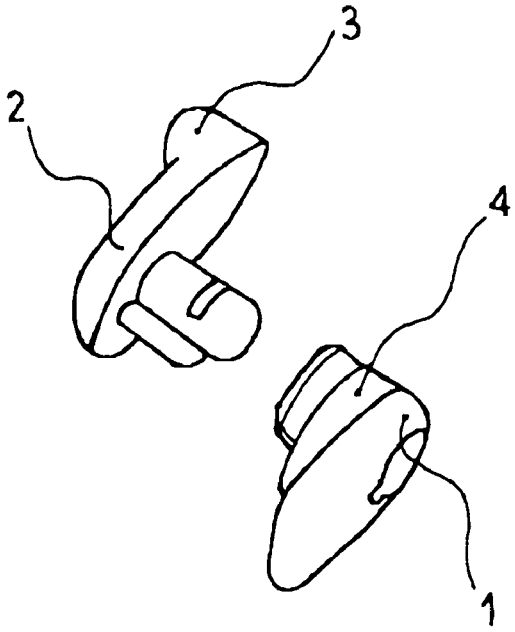
Fig. 1
Fig. 2
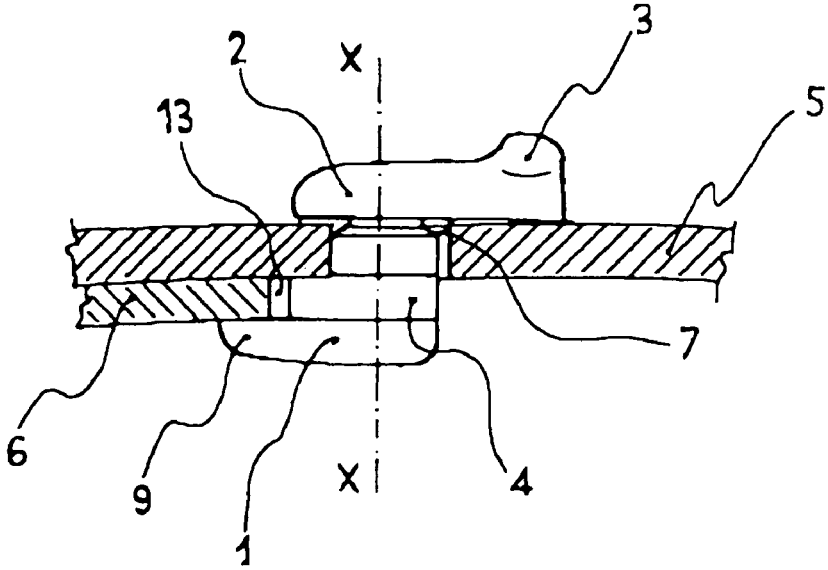

5
4'
13
R5
4
2'
1'
6
1
2
R6
13'

6
9
13
5
1
4

ANTI-FOG VISORS ASSEMBLY

This application claims priority to IT Application No. MI2003U 000411, filed 12 Sep. 2003. The entire contents of this application is incorporated herein by reference.

The present invention relates to an anti-fog visors assembly of the type comprising an external visor and an internal visor, which is at least, partially, kept in abutment on the internal surface of the external visor, by way of mechanical retaining means. In particular, the mechanical retaining means are constituted by at least two retainers, coupled to the external visor, which engage the correspondent seat, or engagement region, usefully located in lateral position on the internal visor.

Different solutions are well known in the technique for avoiding or reducing the fogging of the visor of the protection helmets, principally for helmets to be used in the motorcycle field. The fogging of the visor in a protection helmet for motorcycling, due to the condensation of the steam breath out by the user on the internal surface of the visor (i.e. positioned toward the inside of the helmet), when the same is lowered, is in fact a extremely frequent undesired event, particularly in the so called integral helmets.

An advantageous solution to this problem is to couple an internal visor made of a hydrophilic material, such as for example cellulose acetate, which has anti-fog properties but which is normally slightly resistant to scratches, to an external visor made of a material resistant to scratches, even if it is hydrophobic, such as for example polycarbonate. In order to avoid the fogging of such assembly of visors, the coupling of the internal visor to the external visor has to be clearly a sealed one, i.e. between the external surface of the internal visor and the internal surface of the external visor has to be no humid air flow.

The International Patent Application WO 96/16563 in the name of ARNOLD, teaches an internal visor made of cellulose acetate mechanically retained against an external visor in polycarbonate, such that external surface made of cellulose acetate is completely in contact with the internal surface of the visor made of polycarbonate. The assembly of visors disclosed in the document in the name of Arnold provides two retainers coupled in a firm way to the external visor, and projecting into the internal part of this latter, which engage the semicircular seats provided at the sides of the internal visor, which is elastically deformed and which is shaped in such a way that, when coupled to the two pins if is subject to a tension which avoids the easy disengagement from the some retainers. More particularly, the internal visor of the ARNOLD document has curvature radius slightly higher than the curvature radius of the external visor and thus is forced to engage the internal retainers of the external visor in order for such internal visor being deformed and being placed completely in contact with the internal surface of the external visor, according to a flexed configuration kept in tension by the two retainers.

U.S. Pat. No. 6,405,373 in the name of GRAU provides, in a visor structure similar to the one described in the ARNOLD Application, an external surface of the internal visor made of cellulose acetate having a peripheral edge made of a sealing material, such as for example silicon, which defines an external waterproof air chamber between the two visors, when the internal visor is coupled to the external visor made of polycarbonate through engaging concave seats laterally provided on the internal visor with the correspondent internal retainers of the visors made of polycarbonate. Also in the GRAU visors assembly the internal visors is elastically deformed and is kept in such an elastically deformed state, i.e. in tension, by the two retainers of the external visor.

In such anti-fog visors assemblies, as it is evident to the skilled man in the field, the dimensions and the shape of the two visors and the mechanical retaining means are particularly critical, as well as the duration in time of the plastic materials which constitute the internal visor, which materials can experience relaxation and plastic deformation (creep of the plastic materials).

In fact, in order for the internal visor to be subject to the expected tension and deformation, so to be easily mounted without occasional failures or plastic deformations, there is the need for the dimensions of the two visors and of the eventually different curvature radius for the dimensions and the locations of the external visor and the semicircular seats of the internal visor to be approximately identical to the dimensions and locations theoretically set in the designing. This means that the admitted tolerances in the manufacturing of the two visors and of the two mechanical retaining means, i.e. retainers and seats, have to be extremely strict, this leading to high production costs.

Furthermore, the cellulose acetate, or an other hydrophilic material used for the manufacturing of the internal visor, can experience a partial degradation process in time, which can lead to an enlargement of the coupling seats of the internal visor, to a relaxation of the material and to dimensional shrinkage even if small, both due to mechanical wear at the coupling of the seats with the pins and due the exposition to the thermic energy and to luminous radiations in time (creep), and thus such a process can lead to a lack of the tensioning conditions to which the internal visor has to be submitted—by way of the two pins of the external visors—in order to maintain the tight contact between the two visors. That is, as time passes, it is possible for the visors assembly disclosed in the ARNOLD and GRAU documents to experience degradation or even the failure of the coupling between the retainer and the internal visor, with subsequent reduction of the anti-fog properties.

At last, in both ARNOLD and GRAU solutions, in order to remove the internal visor from the external visor—step which is necessary for example when the replacement of the internal visor is required, which, as mentioned above, can easily deteriorate in time—it is necessary first to disengage the visors assembly from the protection helmet and then to elastically deform the external visor by bending it in such a way to temporarily increase its curvature radius, so to allow for the disengagement of the seats of the internal visor from the pins of the external visor, and so to allow the removal of the internal visor. Consequently the user must remove the visors structure from the cover of the helmet in order to remove the internal visor this requiring a considerable time span and often requiring the operation of specific tools.

For the user of the above mentioned visors assembly, it's impossible to easily remove the internal visor from the external visor or to modify the coupling conditions between the two visors, this being felt as a considerable limitation of such assembly.

Therefore, it is an object of the present invention to provide an anti-fog visors assembly of the aforesaid type that is not subject to the drawbacks of the known technique and which is then easy to be manufactured, that permits an easy mounting and removal of the internal visor and which is not subject to a rapid degradation of the anti-fog properties in time.

This and other objects are achieved by the visors assembly according to the first independent claim and to the subsequent dependent claims.

According to the present invention the anti-fog visors assembly comprises at least an external visor and at least an internal visor maintained, at least partially, in abutment on the internal surface of said external visor by way of mechanical retaining means. Such mechanical retaining means comprise at least two retainers coupled to the external visor, within which the internal visor is lodged and retained. Advantageously, at least one of the two retainers is a pin pivotable with respect to the internal visor and comprises a portion for the engagement with the same internal visor which has at least a region for the loose coupling and at least a region for the tight coupling depending on the rotation angle achieved by the pivotable pin. Moreover the above mentioned pivotable pin is jointed to means for forcing its rotation which means extend externally from the external visor.

The designing of a pivotable pin operable from the outside of the external visor and provided with a portion for the engagement with the internal visor—having a geometry depending on the rotation angle set for the same pivotable pin—permits to modify the conditions of the retaining of the internal visor, simply by rotating such pin. As a consequence, it is possible to provide a region for the loose coupling of such engaging portion, wherein the mounting and the removal of the internal visor on the external visor is simplified, and to provide a region for the tight coupling wherein the internal visor is removable or mountable only in a difficult way. The rotation of the pivotable pin, achieved from the outside of the visors assembly by way of the foresaid means for setting the rotation of the pivotable pin, thus permits easily engage or disengage the internal visor from the external visor, with no need for disengaging in advance the external visor for the cover, neither for deforming the last or for using specific tools.

According to a preferred aspect of the present invention, the internal visor may comprise lateral seats wherein the retainers coupled to the external visor are engaged, and the engagement portion of the pivotable pin may be shaped such a way as to engage the corresponding lateral seat through a cam coupling.

The cam coupling of the surface of the pivotable pin with a lateral seat of the internal visor, as will be clarified in detail in the following description, gives the possibility of varying the tension imposed by the pins to the internal visor, by modifying the arm between the fixed rotation axis of the pin and its engaging point with the concave seat of the internal visor. Therefore, for the mounting and the dismounting of the internal visor it is sufficient to rotate the pivotable pin, by way of the aforesaid external means for imposing its rotation, such a way as to modify the tension which the internal visor is subject to, and consequently to modify the conditions of the coupling of the same internal visor with the external visor, with no need to foresee the deformation of the external visor or the achievement of extremely strict tolerances in the manufacturing of the various parts.

According to another advantageous aspect of the present invention, the mechanical retaining means comprise two pivotable pins provided with a surface for the cam coupling with two respective seats of the internal visor, wherein each pin is integral with respective means for imposing the rotation which means extend to the outside of the external visor.

In this way, both during the assembly step, and during the maintenance step and the eventual replacement, one has the possibility to adjust, easily and in an extremely accurate manner, the tension which the internal visor is submitted to.

In a peculiar embodiment of the present invention the retaining means comprise, in particular, at least an external cap, which is fixable through a suitable hole provided in the external visor to the pivotable pin, in such a way that the group of the pin and the related external gap can jointly rotate. In this case, the above mentioned means for imposing the rotation to the pivotable pin may be constituted by a shaped portion of the same external cap.

According to a further peculiar aspect of the present invention, a blocking tab may be provided over the engaging portion of each pivotable pin, in order to avoid the internal visor from accidentally disengaging the pin.

Some preferred embodiments of the present invention will be described herein after, as non limiting examples considering the enclosed figures, wherein:

FIG. 1 is a perspective view of the mechanical retaining means of a visors assembly according to a preferred aspect of the present invention;

FIG. 2 is a lateral sectional view of an anti-fog visors assembly provided with retaining means shown in FIG. 1;

Figure 3A:
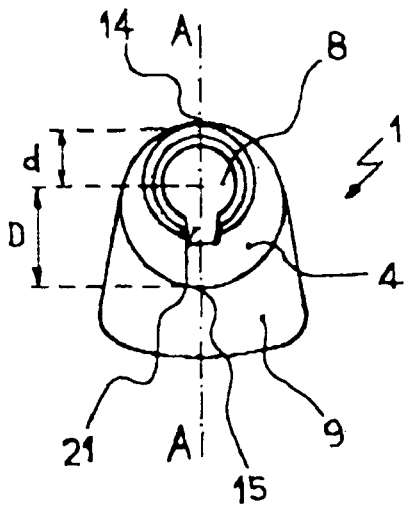
Figure 3B:
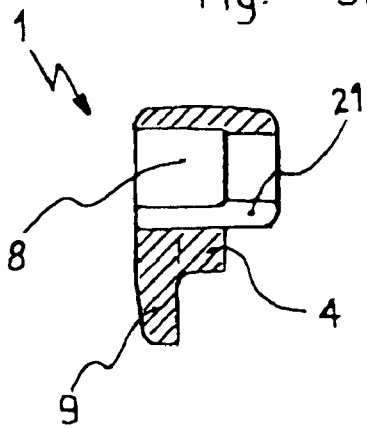
Figure 4A:
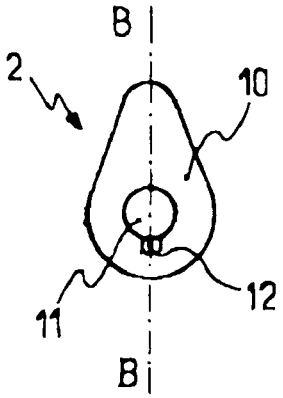
Figure 4C:
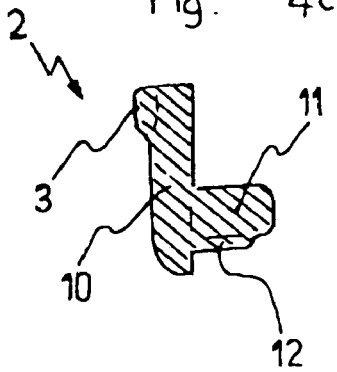
Figure 4B:
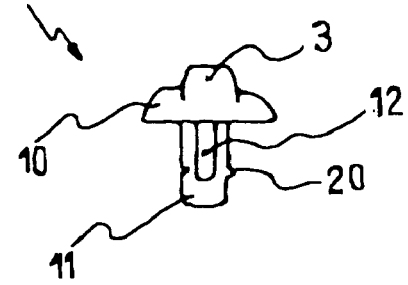

FIGS. 3*a*–3*b* are respectively a plan view form below and a sectional view taken at the dotted line A—A of FIG. 3*a* of a pivotable pin according to a peculiar aspect of the present invention;

FIGS. 4*a*–4*c* are respectively a plan view from below, a lateral view and a sectional view taken at the line B—B in FIG. 4*a* of an external cap for fixing the pin represented in FIGS. 3*a* and 3*b;*

Figure 5:
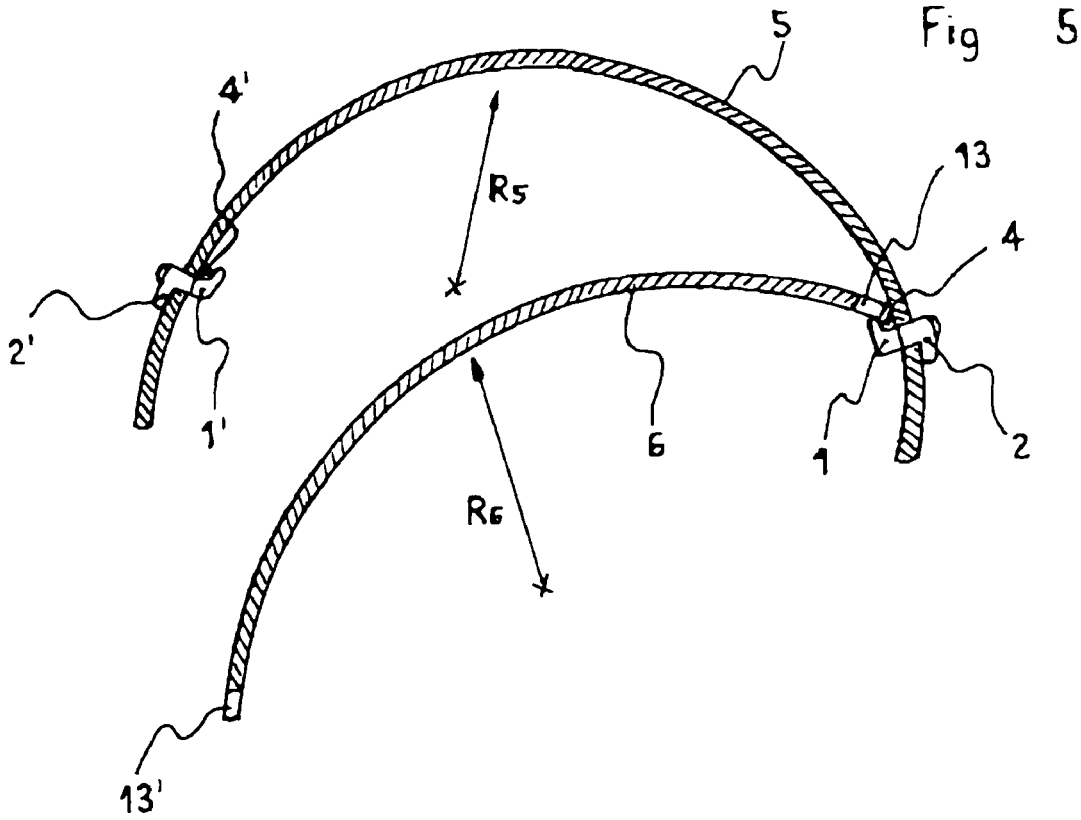
Figure 6:
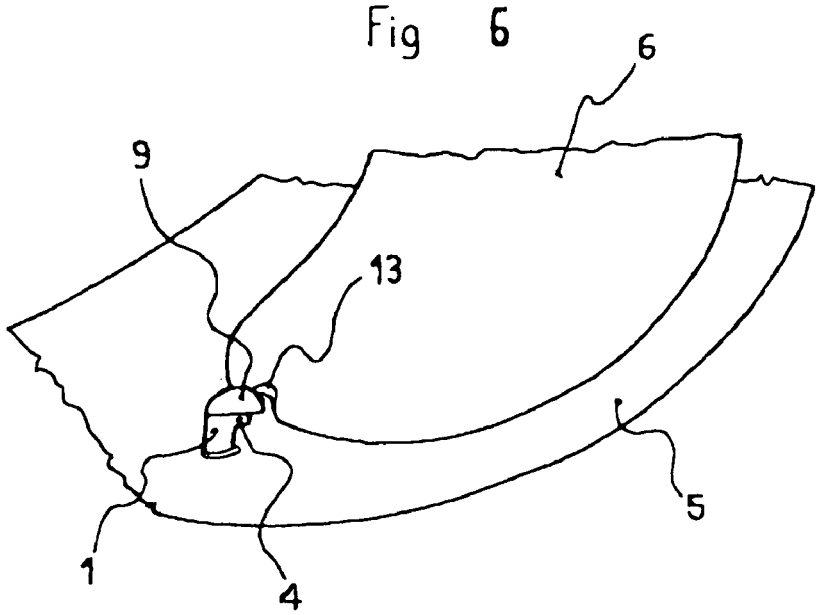

FIG. 5 is a partial sectional view from above of a visors assembly in a preferred embodiment of the present invention;

FIG. 6 is a partial fragmentary view of the visors assembly shown in the previous figures.

Figure 7:
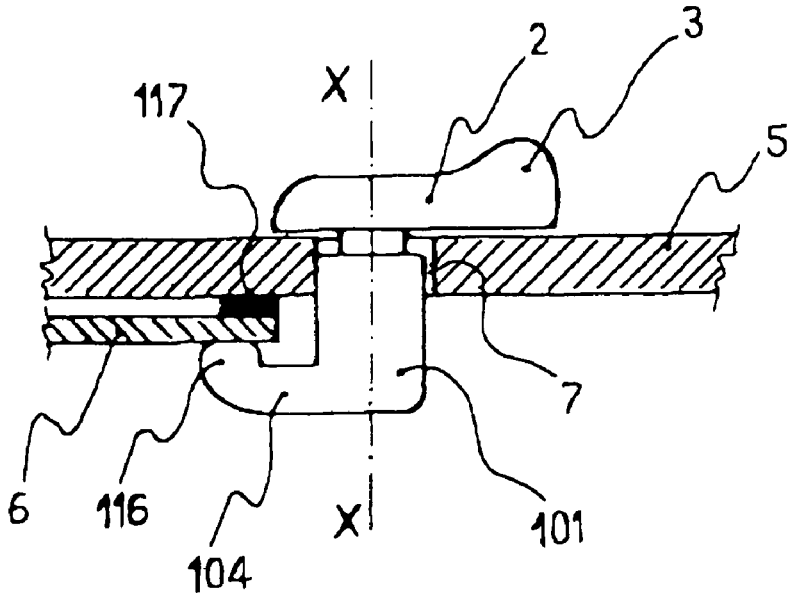
Figure 8:
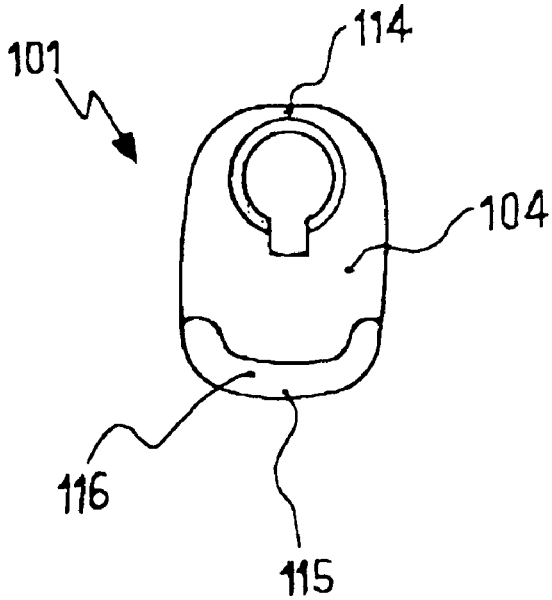

FIG. 7 is a sectional side view of alternative retaining means of the visors assembly according to the present invention; and FIG. 8 is a plan view from below of a pivotable pin of the retaining means of FIG. 7.

With reference to all the figures, the anti-fog visors assembly according to the present invention comprises at least an external visor 5 made of a scratch resistant material, such as polycarbonate, and at least an internal visor 6 made of an anti-fog hydrophilic material, such as for example cellulose acetate, which visor 6 is coupled to the external visor 5 by way of mechanical retaining means 1, 2 (or 101, 2). Such retaining means comprise at least two retainers 1, 1' (or 101), coupled to the external visor 5 and suitable to lodge the aforesaid internal visor 6 in the middle, so to lock it. According to the known technique, the retainers 1, 1'; 101 can retain the internal visor 6 to the external visor 5 in a fix way by transmitting a preset tension at corresponding concave seats 13, 13', which the internal visor 6 may be laterally provided with, and/or by preventing, through interposition of parts, the sliding of the internal visor 6 with respect to the same retainers 1, 1'; 101.

Advantageously, according to the present invention, at least one of such retainers 1, 1'; 101 is a pin 1; 101 pivotable with respect to the internal visor 6 and provided with a portion 4; 104 for the engagement with the same internal visor 6, which portion 4; 104 provides at least a region 14; 114 for the loose engagement and at least a region 15; 115 for the tight engagement with the same visor 6, depending on the rotation angle achieved by the pivotable pin 1; 101.

At this point and in the following description "region for the loose engagement" it is intended a region of the engaging portion 4 for the only partial engagement, or at least for a complete disengagement, of the same portion with the internal visor 6, which allows the user to easily disengage the internal visor 6 from the retainers 1, 1'; 101; while for "region of tight engagement" it is intended a region of the portion 4 which, because of the geometric characteristics of the parts, allows for a firm engagement of the same internal visor 6 with the external visor 5.

According to the present invention, the pin 1; 101 is also fixed to means 3 for imposing the rotation of the some pin 1; 101 and which extend to the outside of the external surface of the external visor 5, i.e. directed toward the air flow impinging the helmet and opposed to the visor 6.

Such means 3, for example constituted by a shaped part securely fixed to the pivotable pin 1; 101 and extended externally from the external visor 5, may be easily made integral with the pin 1; 101 or may be jointed to this latter in a second moment, and allow the manual operation, by rotation, of the same pin 1; 101 by the user, permitting his operation externally from the visors assembly according to the present invention.

In the preferred embodiment shown in the FIGS. 1–6, the mechanical retaining means of the visors assembly according to the present invention comprise two pins 1, 1' engaged with the external visor 5, which project from the internal surface of this latter, and which are shaped to fit with two corresponding concave seats 13, 13' laterally provided along the edge of the internal visor 6.

In the shown embodiment, the dimensions of the internal visor 6 and of its lateral seats 13, 13', also the distance between the retainers 1, 1', and their shape, allow the retaining of the internal visor 6 in full contact with the internal surface of the external visor 5, in a elastically deformed structure of said internal visor 6, so to avoid humid air from flowing between the two visors 5, 6.

In particular, the internal visor 6, which preferably may have a curvature radius $R_6$ higher than the curvature radius $R_5$ of the external visor 5, is elastically deformed (bended) during its assembling between the retainers 1, 1' and is kept in such deformed shape by the same retainers 1, 1' that impose a certain tension on the internal visor 6, thanks to their coupling with the correspondent seats 13, 13'. The elasticity of the material of the internal visor 6 and the bending to which the same internal visor 6 is subject permit an optimal retaining by the retainers 1, 1'.

At least one of the retainers 1, 1' according to the present invention is constituted by a pin 1 which is mounted on the external visor 5 in a pivotable way around an axis X—X, incident the some external visor 5, and which comprise a portion for the engagement with the internal visor 6 constituted by a cylindrical body 4, having a circular base, eccentrically located with respect to the aforesaid rotation axis X—X of the pin 1. In other words, the circular base cylindrical body 4 has its symmetry axis parallel to the rotation axis X—X of the pin 1, standing aside from said rotation axis X—X, so to cam couple itself with a corresponding seat 13, 13' laterally provided on the some internal visor 6.

The pin 1, as it will be clarified later, is also jointed with means 3 for transmitting the rotation which, advantageously, extend to the external side of the external visor 5, so to allow an easy operation by rotating the same pin 1 from the user.

Thus, with particular reference to FIGS. 3*a* and 3*b*, the rotation of the pin 1, thanks to the means 3, allows the cylindrical body 4 to gradually move from a first angular position, wherein a region (or at least a point) 14 for the loose engagement engages the respective seat 13 of the visor 6, to a second angular position wherein a different region (or point) 15 for the tight engagement engages the same seat 13, and vice versa.

In the case that exclusively the pin 1 is of the pivotable type provided with a body 4 arranged in an eccentric way, when the region 14 engages the internal surface of the concave seat 13, the arm d between the rotation axis X—X and the engaging surface of the body 4 is minimum and thus the distance between the outermost engaging points of the pin 1 and of the retainer 1' to the internal visor 6 is the maximum, in this way imposing a minimum, or at least null, tension on the same visor 6 by the retainers 1, 1'. In this configuration, as immediately evident, the assembling or the removal of the internal visor 6 within the retainers 1, 1' is thus made easier.

On the contrary, when the pin 1 is rotated, manually operating on the means 3, in such a way that the region 15—wherein the arm D between the rotation axis X—X and the coupling surface of the body 4 is the maximum—engages the corresponding seat 13, the distance between the outermost engaging points of the pin 1 and the retainer 1' with the visor 6 is the minimum, this requiring the application of a maximum tension on the internal visor 6 by the retainers 1, 1'. This configuration, wherein a maximum tension is applied on the internal visor 6, avoids or highly interferes with every displacement of the internal visor 6.

When both the retainers 1, 1' are of the pivotable type having an eccentrically arranged cylindrical body for the engagement, the contemporary angular positioning of the pins 1, 1'—achievable through the corresponding external means 3 for imposing the rotation of the pins 1, 1', in such a way that the regions of the eccentric cylindrical body 4 for the engagement with the minimum arm d engage the respective concave seat 13, 13' of the internal visor 6—leads to obtain the maximum distance between the retaining points of the same internal visor 6, in this way determining the application of minimum tension to this latter, i.e. leading to a loose linking between the pins 1, 1' and the visor 6.

On the contrary, the application of the maximum tension on the internal visor 6 will be achieved when the regions for the engagement with the maximum arm D are contemporary in engagement with the concave seats 13, 13'—thanks to the rotation of the pins 1, 1'—in this way carrying out a tight link between the pins 1, 1' and the visor 6.

As described above, the rotation of one or both pins 1, 1' of the embodiment of the FIGS. 1–6 permits to modify the engagement conditions of the internal visor 6 with the external visor 5 depending one the angular position achieved by the pins 1, 1', thus adjusting substantially in a continuous way (thanks to the eccentric arrangement of the body 4) the tension which the internal visor 6 may be subject to, when the visor 6 has an elastically deformed structure which put the same visor 6 in partial or full contact with the internal surface of the visor 5.

Such modifications of the engagement conditions thus permit to the manufacturer to provide lower tolerances during the production of the parts of the above mentioned visors assembly and allow the user to assembly or disassembly the internal visor 6 by easily operating from the outside of the external visor 5, by way of the aforesaid means 3 for the application of the rotation to the pins 1, 1', with no need for a first disengagement of the external visor 5 from the helmet cover and without the necessity of specific tools. Moreover, in the case wherein dimensional variations of the internal visor 6 are provided, due for example to the wearing or to creep events, the simple rotation of at least one of the pins 1, 1' also permits to improve the tension which the internal visor 6 is subject to, so that a tight contact between the two visors 5, 6 is ensured.

In a preferred embodiment of the present invention, illustrated in detail in the FIGS. 2, 3*a* and 3*b*, each pin 1, 1' may also be provided with an upper blocking tab 9, suitable to avoid accidental disengagement of the seats 13, 13' with the engagement regions of the eccentric cylindrical bodies 4. Each blocking tab 9, provided above the internal surface of the visor 6, radially extends from the pin 1, 1' only according to an angular range (which comprises the region 15) wherein a tight coupling of the same eccentric cylindrical body 4 with the respective seat 13, 13' of the visor 6 occurs, in such a way that the tab 9 does not impede the removal of the visor when the region 14 for the loose engagement is brought into engagement with the respective seat 13, 13'.

Furthermore, in the embodiment shown in the FIGS. 1–6, the pins 1, 1' are linked to the external visor 5 in a rotatable way with respect to the some visor, thanks to the engagement of such pins 1, 1' with the correspondent caps 2, 2', which extend to the outside of the visor 5 through respective holes 7 provided on the same visor 5. The geometry of the caps 2, 2' and the pins 1, 1' prevents the group constituted by each pin 1, 1' fixed to the respective external cap 2, 2' from slipping off from the hole 7 and at the some time permits the jointly rotation of such group around the axis X—X within the hole 7.

It has to be noticed that, in alternate embodiments not shown, each cap 2 may be integral with the external visor 5 and may engage the correspondent pin 1, 1' in such a way to allow its relative rotation with respect to the same cap 2, 2' which, thus, is fixed with respect to both visors 5, 6.

With reference to the FIGS. 3*a*, 3*b* and 4*a*, 4*b*, in the particular embodiment shown, each external cap 2, 2' comprises an upper portion 10 below which a cylinder 11 projects, provided with a spline 12 and with projections 20. The upper portion 10 comprises a shaped end 3 directed toward the outside of the external visor 5, which end is suitable to simplify the manual operation—in rotation around the axis X—X—of the cap 2 or 2' and the related pin 1 or 1' by the user and which is thus an essential part of the aforesaid means for imposing the rotation to the pin 1 or 1'.

In particular, the lower cylinder 11 is shaped for internally engage a correspondent hollow seat 8 obtained within the pin 1, 1' and provided with a casing 21 for the spline 12. The hollow seat 8 also comprises grooves, not shown, suitable to snap couple with the projections 20, i.e. through interposition of parts upon the spring back of the same projections 20. The snap coupling of the pin 1, 1' with the cap 2, 2' ensures the axial engagement between the two parts, while the presence of the spline 12, which engage within the casing 21, provides the rotation of the cap 2 or 2' jointly with the pin 1 or 1'.

Although the application of an external cap 2, 2' has been described, suitable to retain in a rotatable way each pin 1, 1' to the external visor 5, other known means may be provided for the engagement of the pin 1 to the same visor, as well as suitable means for imposing the rotation of the same pin 1, 1' may be provided, which extend to the outside of the visor 5. For example, the pin 1 may comprise an elastically deformable portion suitable to engage the hole 7 and provided with a grip end for the user.

The FIGS. 7 and 8 show an alternate embodiment of the present invention particularly convenient when the internal visor 6 is partially brought in abutment with the internal surface of the external visor 5, preferably in correspondence of one peripheral edge. For example, the external surface of the internal visor 6, as disclosed in the above mentioned U.S. Pat. No. 6,405,373 (GRAU), may be provided with a frame 117 made of a material impermeable to fluids, such as a silicone material, arranged in correspondence of the peripheral edge of said external surface of the visor 6 and suitable to engage the external visor 5.

By providing this solution, it is possible to use the retainers 101 which can simply retain the internal visor 6 in partial engagement with the visor 5, by way of a shaped area 116 which stands on the internal surface of the same visor 6, with no need for said retainers 101 to necessarily transmit an adjusting tension on the internal visor 6.

More in detail, according to a peculiar aspect of the present invention, each pin 101 of the embodiment shown in the FIGS. 7 and 8 comprises a portion for the engagement with the internal visor 6 constituted by an upper tab 104 which extend beyond the visor 6 of an angular range around the rotation axis X—X of the pin 101. Such tab 104 provides a first region 115 for the tight engagement, which comprises a projection 116 shaped for engage the internal surface of the visor 6 so to transmit a certain pressure to the last, and a second region 114 for the loose engagement, without the elements for the engagement with the same visor 6.

The pin 101, as similarly described with reference to the FIGS. 1–6, is coupled in a pivotable way to the external visor 5, through the hole 7 provided within the visor 5, by way of its coupling to an external cap 2, which is opportunely shaped for snap engage the same pin 101—using a spline—and which is provided with a shaped portion 3 for permitting the operation of the pin 101, by its rotation, from the outside of the external visor 5.

The rotation of the pin 101 around the axis X—X of FIG. 7 allows the user to alternatively engage the tight engagement region 115 with the internal visor 6, in this way retaining the same visor 6 in partial contact with the external visor 5, and with the loose engagement region 114, thus freeing the internal visor 6.

In view of the above, the skilled man will clearly understand that providing pivotable pins of the above mentioned type—i.e. pins which comprise a portion for the engagement with the internal visor having at least a region for the loose engagement and a region for the tight engagement depending on the rotation angle achieved by a same pivotable pin and which are provided with means for imposing the rotation extending outside the external visor, in an anti-fog visors assembly of the type having an internal anti-fog visor which is placed on an external anti-scratch visor—permits to make the tolerances of the parts of such visors assembly higher, with consequent economic advantages, permits to easily mount or dismount the internal visor without the necessity for preventively disengage the external visor from the helmet cover, and permits, when it is required, to adjust in a precise way the tension which the internal visor may be subject to.

The invention claimed is:

1. An anti-fog visors assembly of the type comprising at least an external visor and at least an internal visor maintained in abutment, at least partially, on the internal surface of said external visor by way of mechanical retaining means said mechanical retaining means comprising at least two retainers coupled to said external visor, within which said internal visor is lodged characterized in that at least one of said two retainers is a pin pivotable with respect to said internal visor and comprising a portion for the engagement with said internal visor which has at least a region for the loose engagement and at least a region for the tight engagement, depending on the rotation angle achieved by said at least one pivotable pin, and in that said pivotable pin is coupled to means for forcing its rotation, said means for forcing its rotation extending externally from said external visor.

2. An anti-fog visors assembly of claim 1, wherein said mechanical retaining means also comprise at least a seat, laterally provided within said internal visor, for the engagement with said pivotable pin, the anti-fog visors assembly being characterized in that said portion for the engagement of said pivotable pin is eccentrically shaped with respect to the correspondent seat of the internal visor.

3. An anti-fog visors assembly of claim 2, characterized in that said pivotable pin comprises at least a tab for blocking said internal visor arranged above said portion for the engagement with said internal visor.

4. An anti-fog visors assembly of claim 2, characterized in that said portion for the eccentric engagement comprises at least a disassembly angular position, substantially coincident with said at least one region for the loose engagement wherein the distance between the rotation axis of said pivotable pin and the coupling point with said correspondent seat of said internal visor is minimum, thus said pivotable pin not imposing any tension, or impose a minimum tension, to said internal visor.

5. An anti-fog visors assembly of claim 1, characterized in that said pivotable pin comprises at least a blocking tab which may be arranged above a correspondent region for the engagement with said internal visor, said blocking tab engaging said internal visor exclusively for a preset angular range achieved by said pivotable pin.

6. An anti-fog visors assembly of claim 1, characterized in that it comprises two pins pivotable with respect to said internal visor, each of said two pivotable pins being provided with a portion for the engagement with the internal visor which provides at least a region for the loose engagement and at least a region for the tight engagement depending on the rotation angle achieved by said at least one pivotable pin.

7. An anti-fog visors assembly of claim 1, characterized in that said mechanical retaining means comprise at least an external cap fixable to said at least one pivotable pin through a hole provided in said external visor.

8. An anti-fog visors assembly of claim 7, characterized in that said external cap comprises a shaped portion for the manual operation of said at least one pivotable pin in rotation.

9. An anti-tog visors assembly of claim 7, characterized in that said external cap is fixable through a snap coupling to said pivotable pin.

10. A visors assembly of claim 7, wherein said external cap and said pivotable pin are jointly rotatable within said hole of said external visor.

11. A visors assembly claim 7, wherein said external cap is shaped to prevent the axial sliding of said at least one pivotable pin with respect to said external visor.

12. An anti-fog visors assembly of claim 1, characterized in that the external surface of said internal visor abuts, almost completely, the internal surface of said external visor.

13. An anti-fog visors assembly of claim 1, wherein the external surface of said internal visor abuts only in correspondence of its peripheral edge.

14. An anti-fog visors assembly of claim 1, wherein the curvature radius ($R_6$) of the internal visor is higher than curvature radius ($R_5$) of the external visor.

* * * * *